US010113813B2

(12) United States Patent
Lim et al.

(10) Patent No.: US 10,113,813 B2
(45) Date of Patent: Oct. 30, 2018

(54) TUBE FOR HEAT EXCHANGER

(71) Applicant: Hanon Systems, Daejeon-si (KR)

(72) Inventors: Hong-Young Lim, Daejeon-si (KR); Jun-Young Song, Daejeon-si (KR); Dong-Suk Lee, Daejeon-si (KR); Sung-Hong Shin, Daejeon-si (KR); Kwang-Hun Oh, Daejeon-si (KR); Wi-Sam Jo, Daejeon-si (KR); Yong-Sung Kwon, Daejeon-si (KR); Sun-Mi Lee, Daejeon-si (KR); Daniel Davidson, Plymouth, MI (US); Greg Whitlow, Posen, MI (US); Jiri Dobner, Zadverice (CZ); Young-Sang Kim, Daejeon-si (KR); Jung-Ho Kim, Daejeon-si (KR); Sun-An Jeong, Daejeon-si (KR); Yeong-Ho Jin, Daejeon-si (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 15/110,413

(22) PCT Filed: Feb. 13, 2015

(86) PCT No.: PCT/KR2015/001484
§ 371 (c)(1),
(2) Date: Jul. 8, 2016

(87) PCT Pub. No.: WO2015/126105
PCT Pub. Date: Aug. 27, 2015

(65) Prior Publication Data

US 2016/0356555 A1 Dec. 8, 2016

(30) Foreign Application Priority Data

Feb. 21, 2014 (KR) ..... 10-2014-0020212
Mar. 5, 2014 (KR) ..... 10-2014-0025855
(Continued)

(51) Int. Cl.
*F28F 1/40* (2006.01)
*F28F 3/02* (2006.01)
*F28D 1/03* (2006.01)

(52) U.S. Cl.
CPC ..... *F28F 1/40* (2013.01); *F28D 1/0391* (2013.01); *F28F 3/025* (2013.01); *F28F 2225/04* (2013.01)

(58) Field of Classification Search
CPC ..... F28F 1/40; F28F 1/12; F28F 3/025; F28D 1/0391
See application file for complete search history.

(56) References Cited

U.S. PATENT DOCUMENTS 6,209,202 B1 * 4/2001 Rhodes ..... B21C 37/151 165/177
8,438,728 B2 * 5/2013 Zobel ..... B21C 37/151 165/177
2014/0298653 A1 * 10/2014 Nordlien ..... B23K 35/3601 29/890.046

FOREIGN PATENT DOCUMENTS

CN 103025479 A 4/2013
CN 103080686 A 5/2013
(Continued)

*Primary Examiner* — Len Tran
*Assistant Examiner* — Gordon Jones
(74) *Attorney, Agent, or Firm* — Shumaker, Loop & Kendrick, LLP; James D. Miller

(57) ABSTRACT

A tube for a heat exchanger, and more particularly, a tube for a heat exchanger, which has a first reinforcement portion corresponding to a curved section of a tube and a second
(Continued)

reinforcement portion attached to the first reinforcement portion formed at both ends of an inner fin so as to increase the strength of both ends in the air flow direction of the tube.

14 Claims, 12 Drawing Sheets

(30) Foreign Application Priority Data

Jan. 29, 2015 (KR) ..... 10-2015-0014044
Jan. 29, 2015 (KR) ..... 10-2015-0014045

(56) References Cited

FOREIGN PATENT DOCUMENTS

| | | | | |
|---|---|---|---|---|
| EP | 1243884 | A2 * | 9/2002 | ..... F28D 1/0391 |
| JP | 2000097589 | A | 4/2000 | |
| JP | 2000329488 | A | 11/2000 | |
| JP | 2005214511 | A | 8/2005 | |
| JP | 2011163666 | A | 8/2011 | |
| KR | 1020130100245 | A | 9/2013 | |
| KR | 1020140015766 | A | 2/2014 | |
| WO | 2008011115 | A2 | 1/2008 | |

* cited by examiner

TUBE FOR HEAT EXCHANGER

CROSS-REFERENCE TO RELATED PATENT APPLICATIONS

This patent application is a U.S. National Phase patent application of PCT/KR2015/001484 filed Feb. 13, 2015 which claims priority to KR 10-2015-0014045 filed Jan. 29, 2015, KR 10-2015-0014044 filed on Jan. 29, 2015, KR 10-2014-0025855 filed Mar. 5, 2014, and KR 10-2014-0020212 filed Feb. 21, 2014, the disclosure of each of which is incorporated herein by reference in its entirety.

TECHNICAL FIELD

The present invention relates to a tube for a heat exchanger, and more particularly, to a tube for a heat exchanger which has first reinforcement portions and second reinforcement portions formed on both end portions of an inner fin disposed in the internal space thereof, wherein the first reinforcement portions correspond to curved portions of the tube and the second reinforcement portions are bonded to the first reinforcement portions, thus increasing the strength on both end portions of the tube in an air flow direction of the tube.

BACKGROUND ART

Generally, a heat exchanger as one of components for constituting an air conditioner for a vehicle is adapted to change the state of a heat exchanging medium or perform heat exchange of the heat exchanging medium with outdoor air, thus conducting cooling or heating.

The heat exchanger includes a pair of header tanks spaced apart from each other in parallel to each other, tubes each having both ends fixed to the header tanks to form a heat exchanging medium passage, and fins interposed between the tubes.

Each tube is made by means of extrusion and folding, and the methods for making the tubes are appropriately selected according to the specifications (sizes, weights, pressure resistances, and amounts of heat exchanging medium flow) required by the kinds of heat exchangers.

The method for making the tubes through folding provides better productivity than the method for making the tubes through extrusion, but has lower strength than that.

Further, the tube made through folding is disclosed in Japanese Patent Application Laid-Open No. 2005-214511 (entitled 'heat exchanger'), which is shown in FIG. 1.

As shown in FIG. 1, a tube 5 for a heat exchanger is made of a plate 5*a* that has a clad material 5*c* applied to the external surface thereof in such a manner as to allow bonding portions 47 bent in the left direction of the tube 5 to be bonded to each other. Further, an inner fin 49 is made of a plate 49*a* that has clad materials 49*b* and 49*c* applied to both surfaces thereof in such a manner as to be bent in the internal space of the tube 5.

The conventional tube 5 as shown in FIG. 1 is reinforced in strength through the bonding portions 47 formed in the left direction thereof, but only the plate 5*a* for forming the tube 5 exists in the opposite side to the bonding portions 47, thus making it difficult to achieve good durability.

Particularly, if the heat exchanger is used as a condenser for a vehicle and the left and right portions of FIG. 1 collide against foreign materials, the left and right portions may be absolutely damaged, thus being exposed to the danger that the tube is broken.

To further meet the demand of today's miniaturization trends, the weight of the tube should be reduced, and accordingly, there is a need for the development of a heat exchanger capable of reducing an amount of materials used and providing sufficient durability.

Accordingly, the present invention has been made in view of the above-mentioned problems occurring in the prior art, and it is an object of the present invention to provide a tube for a heat exchanger which has first reinforcement portions and second reinforcement portions formed on both end portions of an inner fin disposed in the internal space thereof, wherein the first reinforcement portions correspond to curved portions of the tube and the second reinforcement portions are bonded to the first reinforcement portions, thus increasing the strength on both end portions of the tube in an air flow direction of the tube.

It is another object of the present invention to provide a tube for a heat exchanger wherein the tube and an inner fin disposed inside the tube are made of thin plates, thus achieving high productivity, increasing strength, and providing good durability.

SUMMARY OF THE INVENTION

To accomplish the above-mentioned objects, according to the present invention, there is provided a tube for a heat exchanger tube, which is connected between a pair of header tanks of the heat exchanger to form a heat exchanging medium passage and has an inner fin disposed at the inside thereof, the tube including: plane portions disposed in parallel to each other in an air flow direction; curved portions formed on both sides thereof to connect the plane portions with each other to a shape of a curve; and first reinforcement portions and second reinforcement portions formed on both end portions of the inner fin, the first reinforcement portions being bonded to the inner surfaces of the curved portions and the second reinforcement portions being extended from the first reinforcement portions and bonded to the first reinforcement portions.

According to the present invention, preferably, the second reinforcement portions of the inner fin are bonded to the external surfaces of the first reinforcement portions and the inner surfaces of the curved portions.

According to the present invention, preferably, the second reinforcement portions of the inner fin are bonded to the internal surfaces of the first reinforcement portions.

According to the present invention, preferably, the tube is formed by bending a first plate, and the first plate has a first partition wall-forming portion and a second partition wall-forming portion formed on given areas of both end portions thereof and a partition wall formed by bonding the first partition wall-forming portion and the second partition wall-forming portion to each other to divide the internal space of the tube into a first space portion and a second space portion in the air flow direction of the tube.

According to the present invention, preferably, the first plate includes: a first extension portion extended from the end portion of the first partition wall-forming portion and bonded to the opposite surface of the first partition wall-forming portion to the surface of the first partition wall-forming portion contacted with the second partition wall-forming portion; and a second extension portion extended from the end portion of the second partition wall-forming portion and bonded to the opposite surface of the second partition wall-forming portion to the surface of the second partition wall-forming portion contacted with the first partition wall-forming portion.

According to the present invention, preferably, the first partition wall-forming portion and the second partition wall-forming portion have a bonding area formed to bond given areas of the first partition wall-forming portion and the second partition wall-forming portion to each other on the outside of the tube and a space-forming area formed at a first angle on the remaining areas of the first partition wall-forming portion and the second partition wall-forming portion to form a third space portion among the first partition wall-forming portion, the second partition wall-forming portion and the inner fin.

According to the present invention, preferably, the first angle is in the range of 10 to 30°.

According to the present invention, preferably, the first partition wall-forming portion and the second partition wall-forming portion have a second angle formed when coming into contact with the external surface of the tube, and the second angle is in the range of 5 to 15°.

According to the present invention, preferably, the inner fin has a third angle formed between a reference line vertical to the air flow direction with respect to the center of the curvature radius of the curved portion of the tube and a line connecting the end of the second reinforcement portion and the center of the curvature radius of the curved portion of the tube, and the third angle is in the range of 10 to 45°.

According to the present invention, preferably, the inner fin is formed by bending a second plate, and the second plate has bonding portions and partitioning portions alternately formed thereon, the bonding portions being bonded to the plane portions of the tube to partition the internal space of the tube into a plurality of space portions and the partitioning portions being bent from the bending portions to partition the internal space of the tube in the air flow direction.

According to the present invention, preferably, the inner fin further comprises third reinforcement portions extended from the second reinforcement portions and bonded to the bonding portions.

According to the present invention, preferably, if a clad material is applied to the external surface of the first plate, the clad material is applied to both side surfaces of the second plate, respectively, and if the clad material is applied to both side surfaces of one of the first plate and the second plate, no clad material is applied to the other plate.

According to the present invention, preferably, the first plate has a thickness in the range of 0.1 to 0.2 mm, and the second plate has a thickness in the range of 0.05 to 0.12 mm.

According to the present invention, the tube for a heat exchanger has the first reinforcement portions and the second reinforcement portions formed on both end portions of the inner fin disposed in the internal space thereof, and the first reinforcement portions correspond to the curved portions of the tube and the second reinforcement portions are bonded to the first reinforcement portions, thus increasing the strength on both end portions of the tube in the air flow direction of the tube.

Further, the tube and the inner fin disposed inside the tube are made of thin plates, thus achieving high productivity, increasing strength, and providing good durability.

Figure 1:
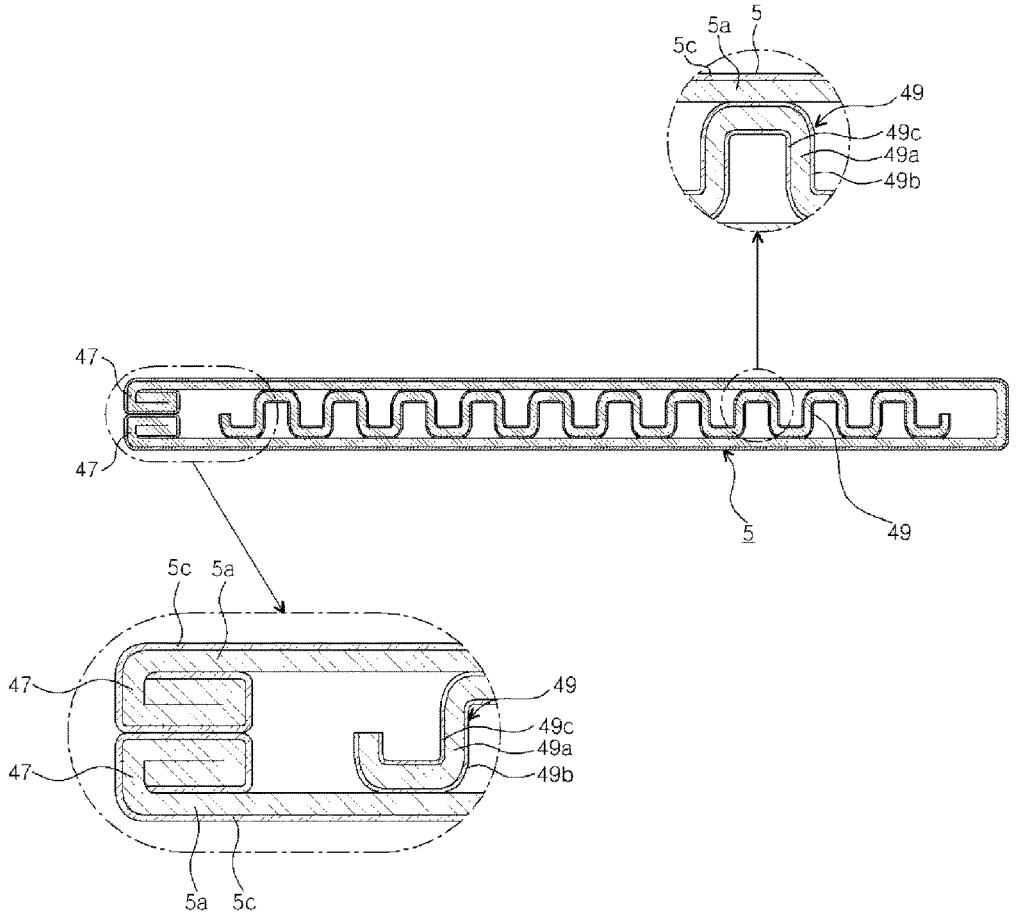
FIG. 1 PRIOR ART
FIG. 1 is a sectional view showing a conventional tube for a heat exchanger.

*Explanations on Reference Numerals in the drawing*

| | |
|---|---|
| 1000: heat exchanger | |
| 100: tube for heat exchanger | |
| 100a: first space portion | |
| 100b: second space portion | |
| 100c: third space portion | |
| 101: plane portion | 102: curved portion |
| 103: partition wall | |
| 110: first plate | 110a: clad material |
| 111: first partition wall-forming portion | |
| 111-1: first bending portion | |
| 112: second partition wall-forming portion | |
| 112-1: second bending portion | |
| 120: inner fin | |
| 121: second plate | 121a: clad material |
| 131: first reinforcement portion | |
| 132: second reinforcement portion | |
| 132a: third reinforcement portion | |
| 133: partitioning portion | 134: bonding portion |

-continued

| *Explanations on Reference Numerals in the drawing* | |
|---|---|
| 200: fin | |
| 310: first header tank | |
| 20: second header tank | |
| 410: inlet pipe | |
| 420: outlet pipe | |
| 500: liquid-vapor separator | |
| α: first angle | |
| β: second angle | |
| A1: bonding area | A2: space-forming area |
| γ: third angle | δ: fourth angle |
| L: reference line | C: center |
| L': auxiliary reference line | |
| L132: line connecting the end of second reinforcement portion and the center | |

DESCRIPTION OF EMBODIMENTS OF THE INVENTION

Hereinafter, an explanation on a tube for a heat exchanger according to the present invention will be in detail given with reference to the attached drawing.

According to the present invention, a tube 100 for a heat exchanger is connected between a pair of header tanks 310 and 320 to form a heat exchanging medium passage and has an inner fin 120 disposed therein.

Figure 2:
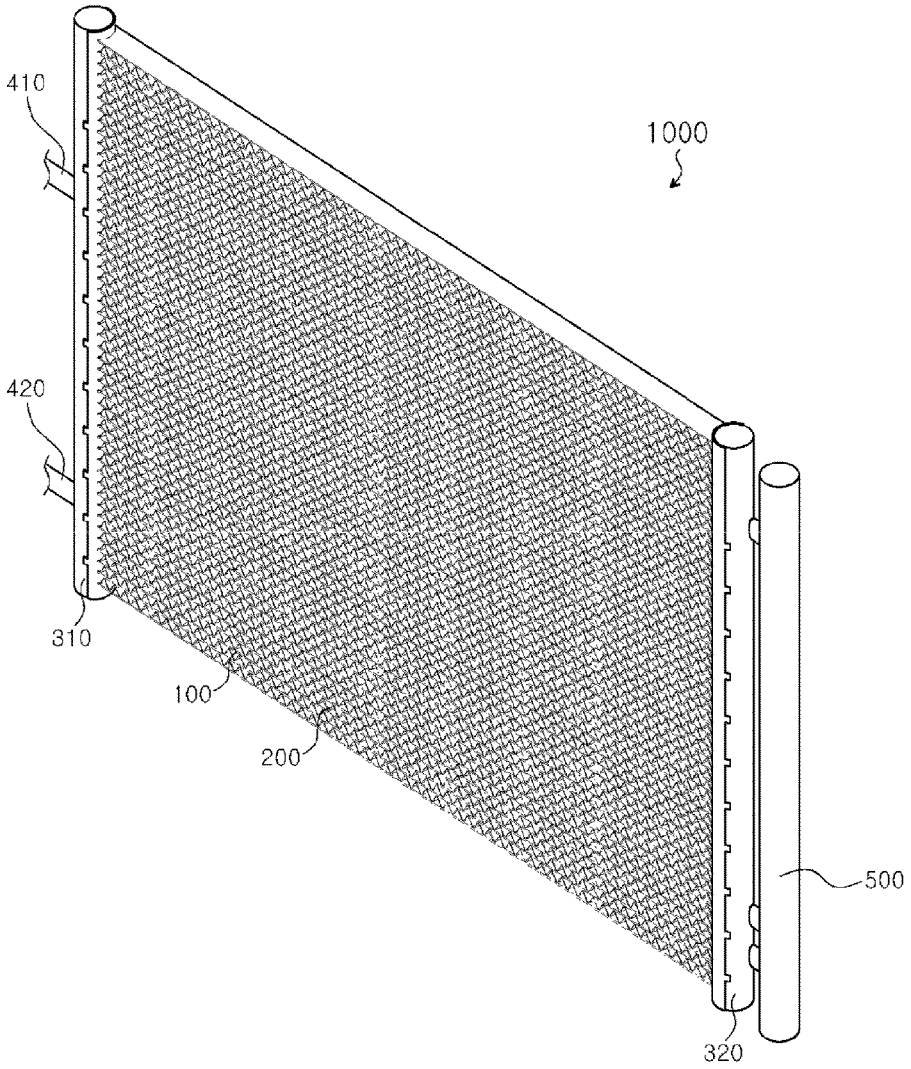
FIG. 2 is a perspective view showing a heat exchanger using a tube for a heat exchanger according to a first embodiment of the present invention.

FIG. 2 is a perspective view showing a heat exchanger using a tube for a heat exchanger according to a first embodiment of the present invention, wherein a heat exchanger 1000 is used as a condenser.

The heat exchanger 1000 (the condenser) is configured to thermally exchange a high temperature and high pressure vapor refrigerant discharged from a compressor with outdoor air, to condense the thermally exchanged refrigerant to a high temperature and high pressure liquid, and to discharge the condensed liquid to an expansion valve, and accordingly, the heat exchanger 1000 provides a cooling module, together with a radiator (not shown) and a fan/shroud assembly (not shown).

Referring in detail to FIG. 2, the heat exchanger 1000 includes the pair of header tanks 310 and 320, an inlet pipe 410 and an outlet pipe 420 disposed on the pair of header tanks 310 and 320 to introduce and discharge a refrigerant, tubes 100 each having both ends fixed to the header tanks 310 and 320, fins 200 interposed between the tubes 100 on the outside of the tubes 100, and a vapor-liquid separator 500 for separating a liquid refrigerant and a gaseous refrigerant to supply only the liquid refrigerant.

The tube 100 for the heat exchanger according to the present invention is applicable to the condenser, and further, it may be applied to other heat exchangers including an evaporator.

The evaporator is the heat exchanger 1000 that thermally exchanges a low pressure liquid refrigerant throttled in an expansion valve with the air blowing to the interior of a vehicle, evaporates the liquid refrigerant, and cools the air in the interior of the vehicle through the heat absorption of the latent heat of evaporation of the refrigerant, and in this case, the entire configuration of the evaporator except the vapor-liquid separator 500 is similar to that of the condenser.

Now, the tube 100 for the heat exchanger according to the present invention will be in detail explained.

Figure 3:
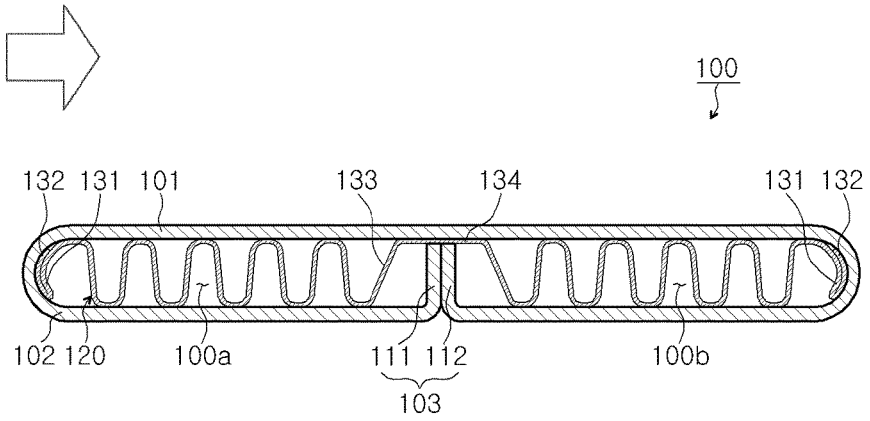
FIG. 3 is a sectional view showing the tube for a heat exchanger according to the first embodiment of the present invention.

FIG. 3 is a sectional view showing the tube for a heat exchanger according to the first embodiment of the present invention. According to the present invention, the tube 100 for the heat exchanger has curved portions 102 curvedly formed on both end portions thereof and first reinforcement portions 131 and second reinforcement portions 132 formed on both end portions of the inner fin 120, respectively.

An air flow direction in FIG. 3 is indicated by an arrow.

The tube 100 for the heat exchanger includes plane portions 101 disposed in parallel to each other in the air flow direction thereof and the curved portions 102 formed on both sides thereof to connect the plane portions 101 with each other to a shape of a curve, thus forming a heat exchanging medium passage therein, and further, the tube 100 has the inner fin 120 disposed therein.

At this time, the tube 100 for the heat exchanger is formed by bending a first plate 110.

Further, the tube 100 for the heat exchanger divides the heat exchanging medium passage formed therein into a first space portion 100*a* and a second space portion 100*b* by means of a partition wall 103, and in this case, a first partition wall-forming portion 111 and a second partition wall-forming portion 112 formed on given areas of both end portions of the first plate 110 are bonded to each other to form the partition wall 103.

The inner fin 120 divides the first space portion 100*a* and the second space portion 100*b* into a plurality of space portions through bending of a second plate 121, and in more detail, the inner fin 120 includes partitioning portions 133 for partitioning the internal space (the first space portion 100*a* and the second space portion 100*b*) of the tube 100 and bonding portions 134 bent from the partitioning portions 133 in such a manner as to be parallel to the plane portions 101 of the tube 100 and bonded to the plane portions 101 of the tube 100.

As shown in FIG. 3, for example, 10 partitioning portions 133 are formed in the first space portion 100*a*, so that the first space portion 100*a* is divided into 11 space portions in the air flow direction, and also, 10 partitioning portions 133 are formed in the second space portion 100*b*, so that the second space portion 100*b* is divided into 11 space portions in the air flow direction.

Otherwise, the number of bending times of the inner fin 120 is adjustable to increase and decrease the number of partitioning portions 133 formed in the tube 100, so that the internal space portions of the first space portion 100*a* and the second space portion 100*b* can be freely adjusted.

At this time, one side surface of the bonding portion 134 of the inner fin 120 for forming the partition wall 103 is bonded to the inner surface of the plane portion 101 of the tube 100, and the other side surface thereof is bonded to the first partition wall-forming portion 111 and the second partition wall-forming portion 112.

According to the present invention, the inner fin 120 of the tube 100 includes the first reinforcement portions 131 corresponding to the curved portions 102 and the second reinforcement portions 132 extended from the first reinforcement portions 131 in such a manner as to be bonded to the external surfaces of the first reinforcement portions 131, on both end portions thereof.

The first reinforcement portions 131 and the second reinforcement portions 132 serve to reinforce the strengths of the curved portions 102 of the tube 100, so that the tube 100 for the heat exchanger according to the present invention can improve the strengths of both end portions thereof in the air flow direction, and accordingly, even if external foreign materials collide against the curved portions 102, the tube 100 may be not damaged at all through high durability.

In more detail, the first reinforcement portions 131 are formed on both end portions of the inner fin 120 in such a manner as to correspond to the curved portions 102 formed at the inside of the tube 100.

Further, the second reinforcement portions 132 are extended from the first reinforcement portions 131 in such a manner as to be bonded to the external surfaces of the first reinforcement portions 131 and the inner surfaces of the curved portions 102. That is, the second reinforcement portions 132 are brought into contact with the inner surfaces of the curved portions 102 and the external surfaces of the first reinforcement portions 131, so that they can be more rigidly bonded to the inner surfaces of the curved portions 102 and the external surfaces of the first reinforcement portions 131 through the contacting force applied toward the inside direction of the tube 100 from the curved portions 102 formed on both sides of the tube 100, thus providing high durability for the tube 100 according to the present invention.

Especially, since the condenser is disposed at the front side of a vehicle, the curved portions 102 may be broken when collide against foreign materials while the vehicle is being driven. According to the present invention, however, the tube 100 for the heat exchanger has the first reinforcement portions 131 and the second reinforcement portions 132 formed on the areas where the curved portions 102 are formed, thus improving the durability of the tube 100.

Figure 4:
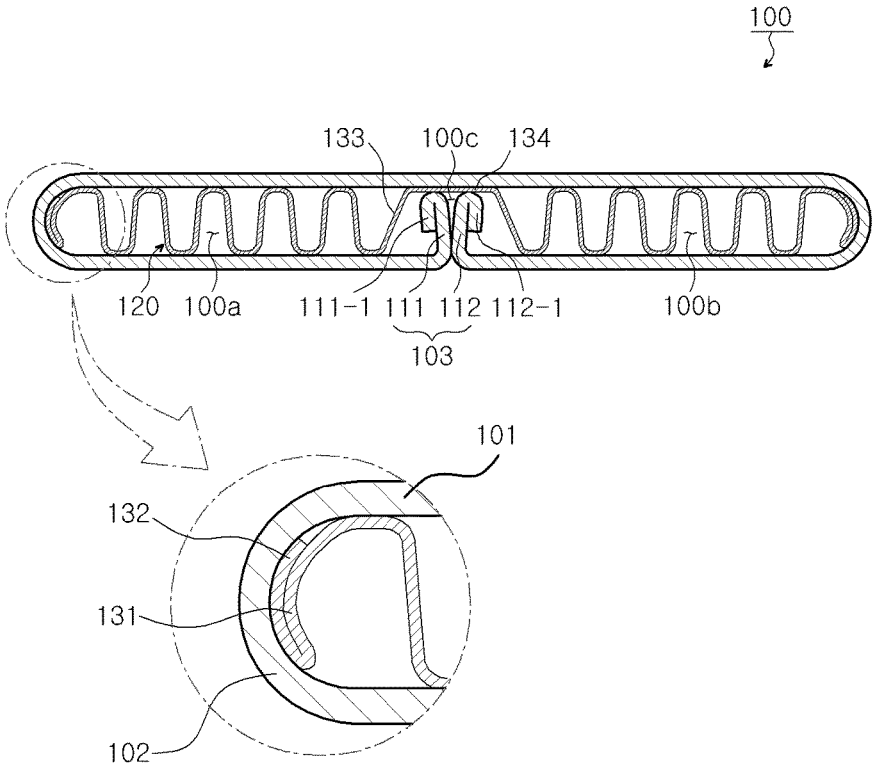
FIG. 4 is a sectional view showing a tube for a heat exchanger according to a second embodiment of the present invention.
Figure 5:
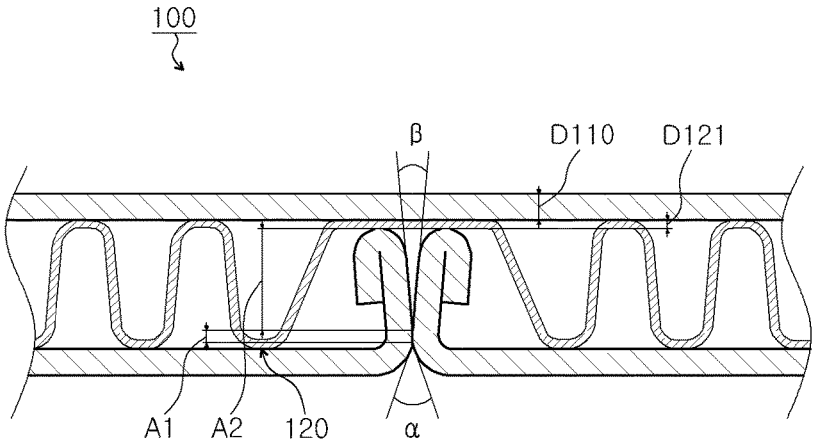
FIG. 5 is an enlarged sectional view showing a portion (wherein a partition wall is formed) of the tube for the heat exchanger of FIG. 4.

FIG. 4 is a sectional view showing a tube for a heat exchanger according to a second embodiment of the present invention, and FIG. 5 is an enlarged sectional view showing a portion where the partition wall is formed of the tube for the heat exchanger of FIG. 4. According to the second embodiment of the present invention, the tube 100 for the heat exchanger further includes a first extension portion 111-1 extended from the first partition wall-forming portion 111 and a second extension portion 112-1 extended from the second partition wall-forming portion 112.

The first extension portion 111-1 is extended from the end portion of the first partition wall-forming portion 111 and bonded to the opposite surface (in FIG. 4, the surface of the first partition wall-forming portion 111 contacted with the first space portion 100*a*, that is, the left side surface of the first partition wall-forming portion 111) of the first partition wall-forming portion 111 to the surface of the first partition wall-forming portion 111 contacted with the second partition wall-forming portion 112.

The second extension portion 112-1 is extended from the end portion of the second partition wall-forming portion 112 and bonded to the opposite surface (in FIG. 4, the surface of the second partition wall-forming portion 112 contacted with the second space portion 100*b*, that is, the right side surface of the second partition wall-forming portion 112) of the second partition wall-forming portion 112 to the surface of the second partition wall-forming portion 112 contacted with the first partition wall-forming portion 111.

Through the formation of the first extension portion 111-1 and the second extension portion 112-1, the partition wall 103 can be stably formed, without having any failure in bonding, thus enhancing manufacturing efficiencies.

Further, as shown in FIG. 5, the first partition wall-forming portion 111 and the second partition wall-forming portion 112 further have a bonding area A1 and a space-forming area A2 formed in the inside direction (in FIG. 5, toward the upper side direction from the lower side direction) of the tube 100 from the outside of the tube 100.

The bonding area A1 is the area wherein given areas of the first partition wall-forming portion 111 and the second partition wall-forming portion 112 are bonded to each other on the outside of the tube 100.

The space-forming area A2 is formed at a first angle α on the remaining areas of the first partition wall-forming portion 111 and the second partition wall-forming portion 112, so that a third space portion 100*c* is formed among the first partition wall-forming portion 111, the second partition wall-forming portion 112 and the inner fin 120 (the bonding portion 134 of the inner fin 120 on which the partition wall 103 is formed).

The third space portion 100*c* is a separate space portion that is defined by the first partition wall-forming portion 111, the second partition wall-forming portion 112 and the inner fin 120 and partitioned from the first space portion 100*a* and the second space portion 100*b* of the tube 100. In the state where the first plate 110 and the second plate 121 are temporarily coupled to each other, as shown in FIG. 5, the third space portion 100*c* is hollow, but through post brazing, the third space portion 100*c* forms the space in which clad materials 110*a* and 121*a* of the first plate 110 and the second plate 121 are collected, so that when a product is completely made, a given or entire area of the third space portion 100*c* may be blocked by means of the clad materials 110*a* and 121*a*.

If the clad materials 110*a* and 121*a* used for the brazing bonding are disposed in the tube 100 in large quantities, erosion may occur due to the clad materials 110*a* and 121*a*, but according to the present invention, the formation of the third space portion 100*c* prevents the occurrence of the erosion.

At this time, the first angle α formed by the first partition wall-forming portion 111 and the second partition wall-forming portion 112 from the bonding area A1 is desirably in the range of 10 to 15°.

If the first angle α is less than 10°, the area of the third space portion 100*c* becomes small so that the advantages in the formation of the third space portion 100*c* cannot be obtained, and contrarily, if the first angle α is more than 15°, the areas of the first space portion 100*a* and the second space portion 100*b* along which the heat exchanging medium flows become small so that the heat exchange performance may be deteriorated.

According to the present invention, accordingly, the first angle α is desirably in the range of 10 to 15°.

Further, a second angle between the first partition wall-forming portion 111 and the second partition wall-forming portion 112 contacted with each other on the outside of the tube 100 is desirably in the range of 5 to 15°.

Figure 6:
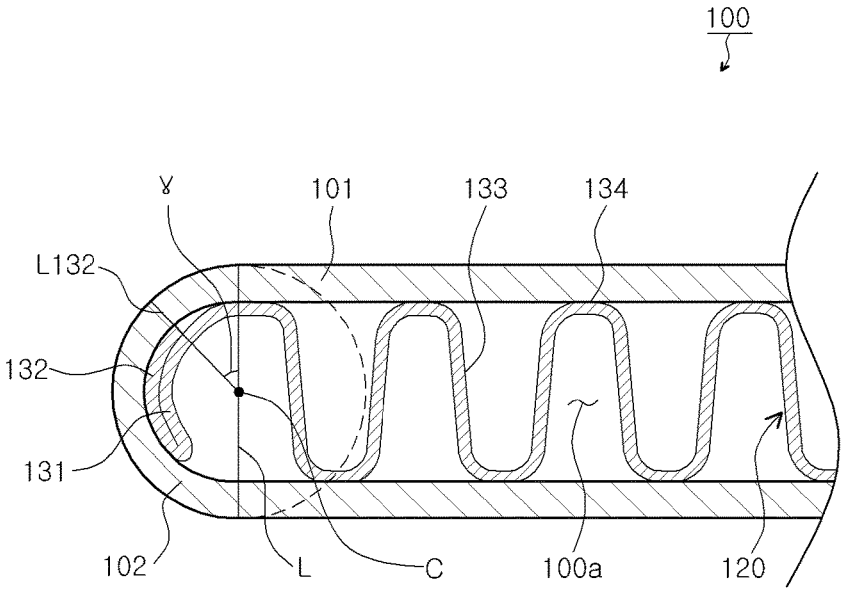
FIGS. 6 and 7 are enlarged sectional views showing another portion of the tube for the heat exchanger of FIG. 4.
Figure 7:
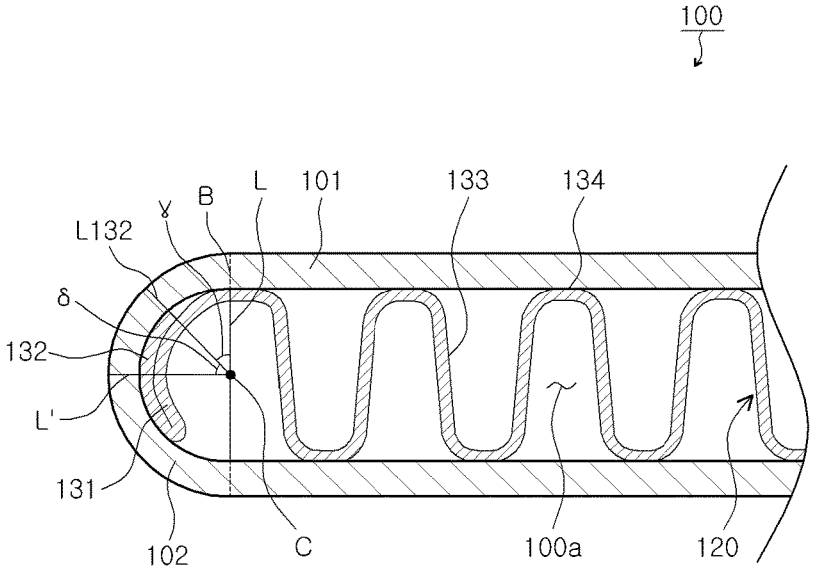

On the other hand, FIGS. 6 and 7 are enlarged sectional views showing another portion of the tube for the heat exchanger of FIG. 4, wherein a third angle γ is indicated. In more detail, FIG. 6 shows the third angle γ formed with respect to the curvature radius of the curved portion 102 and FIG. 7 shows the third angle γ formed with respect to a reference line L connecting both end portions of the curved portion 102.

First, as shown in FIG. 6, the inner fin 120 has the third angle γ formed between a reference line L vertical to the air flow direction with respect to the center C of the curvature radius of the curved portion 102 of the tube 100 and a line L132 connecting the end of the second reinforcement portion 132 and the center C of the curvature radius of the curved portion 102 of the tube 100, and the third angle γ is desirably in the range of 10 to 45°. The center C of the curvature radius of the curved portion 102 means the center of a circle around the outer periphery of the curved portion 102. As shown in FIG. 6, the circle formed around the outer periphery of the curved portion 102 is indicated by a dotted line. Further, the reference line L vertical to the air flow direction means the line vertical to the air flow direction that passes through the center C of the curvature radius of the curved portion 102, and as the plane portions 101 of the tube 100 are formed in parallel to the air flow direction, the reference line L is formed vertically with respect to the plane portions 101 of the tube 100. The line L132 connects the end of the second reinforcement portion 132 and the center C of the curvature radius of the curved portion 102. That is, the third angle γ means the angle between the reference line L where the second reinforcement portion 132 is not formed and the line L132 connecting the end of the second reinforcement portion 132 and the center C of the curvature radius of the curved portion 102. According to the present invention, the third angle γ is desirably in the range of 10 to 45°. If the third angle γ is more than 45°, it is hard to sufficiently reinforce the curved portion 102 through the second reinforcement portion 132. Contrarily, if the third angle γ is less than 10°, the curved portion 102 is excessively reinforced, thus unnecessarily increasing the length of the inner fin 120 to cause both of the weight of the tube 100 itself and the weight of the heat exchanger to be increased. Accordingly, the manufacturing cost is also raised, and the total weight of the vehicle is increased to give bad influences on the fuel efficiency of the vehicle. That is, the tube 100 for the heat exchanger according to the present invention has the third angle γ formed in the range of 10 to 45°, so that the second reinforcement portion 132 is formed at an optimal position, while serving to sufficiently reinforce the curved portion 102.

According to the present invention, further, the third angle γ may be defined differently from that as shown in FIG. 6. As shown in FIG. 7, the third angle γ means the angle formed between a reference line L connecting both end portions of the curved portion 102 and a line L132 connecting the center C of the reference line L and the end of the second reinforcement portion 132. Both end portions of the curved portion 102 are the portions coming into contact with the plane portions 101, and as shown in FIG. 7, they are denoted by a reference symbol B. At this time, the reference line L means the line connecting both end portions of the curved portion 102, that is, the portions wherein the plane portions 101 start, and the third angle γ is formed between the reference line L and the line L132 connecting the center C of the reference line L connecting both end portions of the curved portion 102 and the end of the second reinforcement portion 132. The third angle γ as shown in FIG. 7 is desirably in the range of 10 to 45°, which is explained above. At this time, even if the center C and the reference line L as shown in FIGS. 6 and 7 are defined in different ways from each other, they are at the same position as each other.

According to the present invention, further, a fourth angle δ, which is formed between an auxiliary reference line L' parallel to the plane portions 101 with respect to the center C and the line L132 connecting the center C of the reference line L and the end of the second reinforcement portion 132, is desirably in the range of 45 to 80°. The auxiliary reference line L' and the fourth angle δ are shown in FIG. 7. That is, the fourth angle δ is desirably in the range of 45 to 80°, so that the second reinforcement portion 132 has an appropriate length, while serving to sufficiently reinforce the curved portion 102. At this time, the fourth angle δ is shown only in FIG. 7, but of course, the auxiliary reference line L' passing through the center C and the fourth angle δ defined thereby may be shown in FIG. 6.

Figure 8:
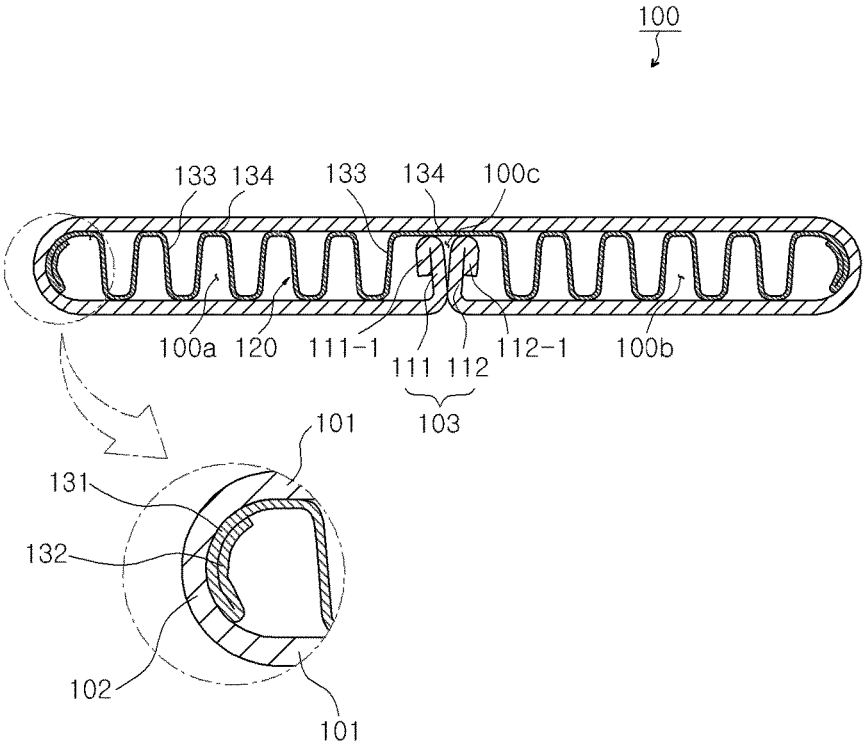
FIG. 8 is a sectional view showing a tube for a heat exchanger according to a third embodiment of the present invention.
Figure 9:
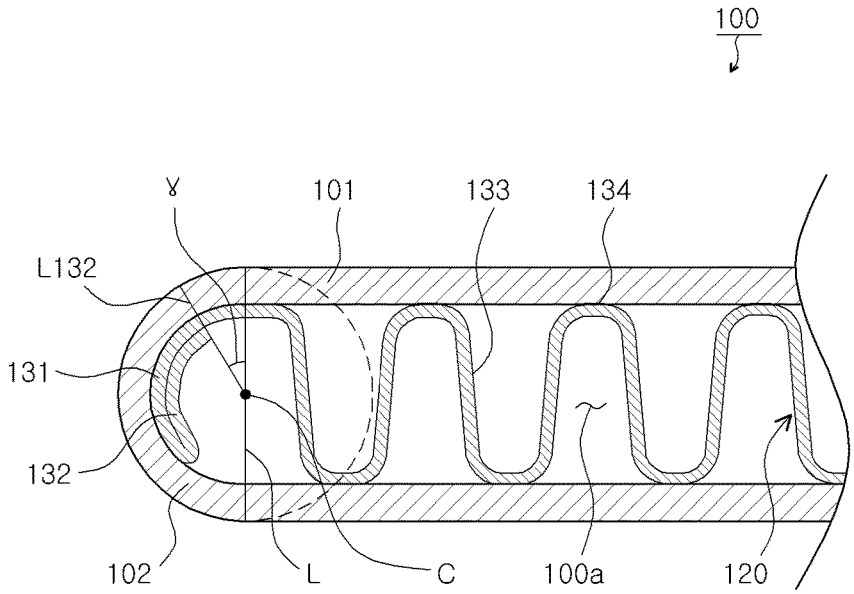
FIGS. 9 and 10 are partially enlarged sectional views showing the tube for the heat exchanger of FIG. 8.
Figure 10:
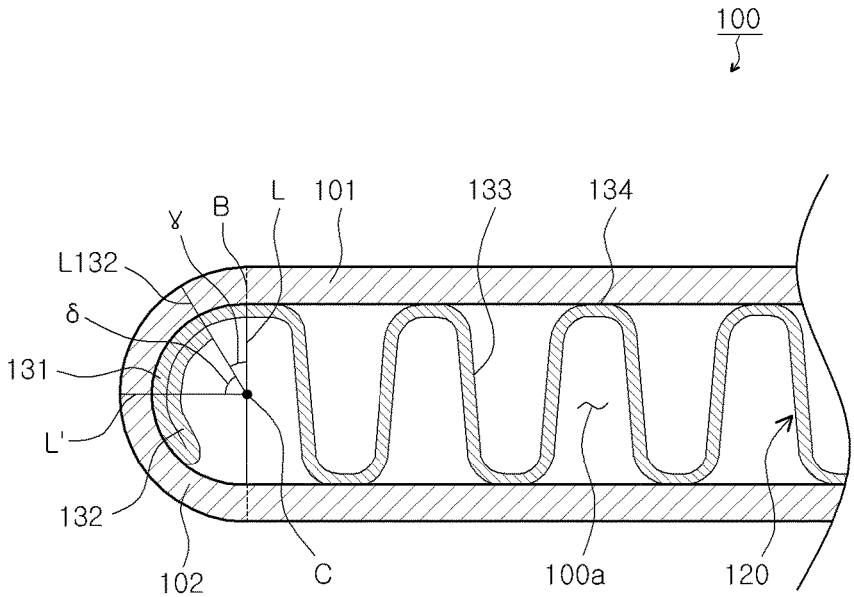

FIG. 8 is a sectional view showing a tube for a heat exchanger according to a third embodiment of the present invention, and FIGS. 9 and 10 are partially enlarged sectional views showing the tube for the heat exchanger of FIG. 8. According to the third embodiment of the present invention, the first reinforcement portions 131 and the second reinforcement portions 132 are formed on both end portions of the inner fin 120, and in this case, the second reinforcement portions 132 are bonded to the inner surfaces of the first reinforcement portions 131. In more detail, the first reinforcement portions 131 are bonded to the inner peripheries of the curved portions 102 of the tube 100, and the second reinforcement portions 132 are extended from the first reinforcement portions 131 to additionally reinforce the areas where the curved portions 102 of the tube 100 are formed and bonded to the inner surfaces of the first reinforcement portions 131. In the same manner above, as shown in FIG. 9, the third angle γ, which is formed between the reference line L vertical to the air flow direction with respect to the center C of the curvature radius of the curved portion 102 and the line L132 connecting the end of the second reinforcement portion 132 and the center C of the curvature radius of the curved portion 102, is desirably in the range of 10 to 45°, and as shown in FIG. 10, the third angle γ, which is formed between the reference line L connecting both end portions of the curved portion 102 and the line L132 connecting the center C of the reference line L and the end of the second reinforcement portion 132, is desirably in the range of 10 to 45°.

Figure 11:
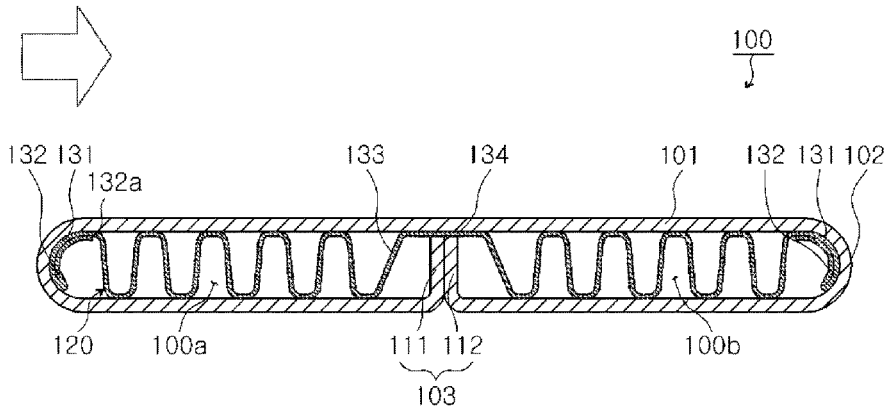
FIGS. 11 and 12 are sectional views showing tubes for a heat exchanger according to fourth and fifth embodiments of the present invention.
Figure 12:
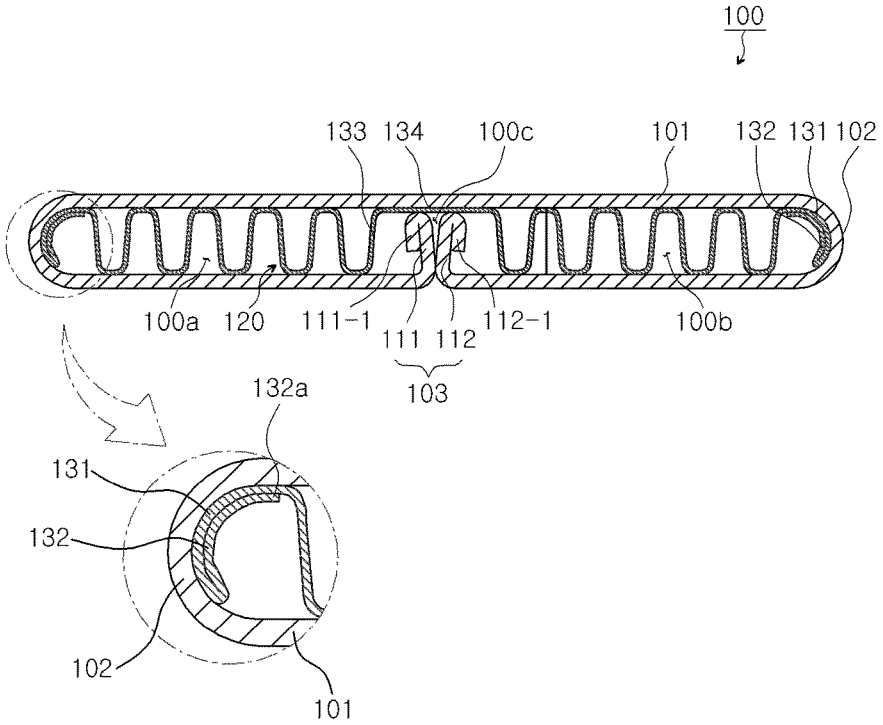

FIGS. 11 and 12 are sectional views showing tubes for a heat exchanger according to fourth and fifth embodiments of the present invention. According to the fourth embodiment of the present invention, as shown in FIG. 11, a tube 100 for a heat exchanger is similar to that as shown in FIG. 8, but it further includes third reinforcement portions 132*a* extended from the second reinforcement portions 132 and bonded to the bonding portions 134. At this time, FIG. 11 shows an example where the first partition wall-forming portion 111 and the second partition wall-forming portion 112 are bonded to each other to form the partition wall 103, and FIG. 12 shows an example where the first extension portion 111-1 is extended from the first partition wall-forming portion 111 and the second extension portion 112-1 is extended from the second partition wall-forming portion 112. As shown in FIGS. 11 and 12, the tube 100 for the heat exchanger includes the first reinforcement portions 131 bonded to the curved portions 102 of the tube 100, the second reinforcement portions 132 bonded to the first reinforcement portions 131, and the third reinforcement portions 132*a* bonded to the bonding portions 134, on both end portions of the inner fin 120, thus providing relatively higher durability for the tube 100.

Figure 13:
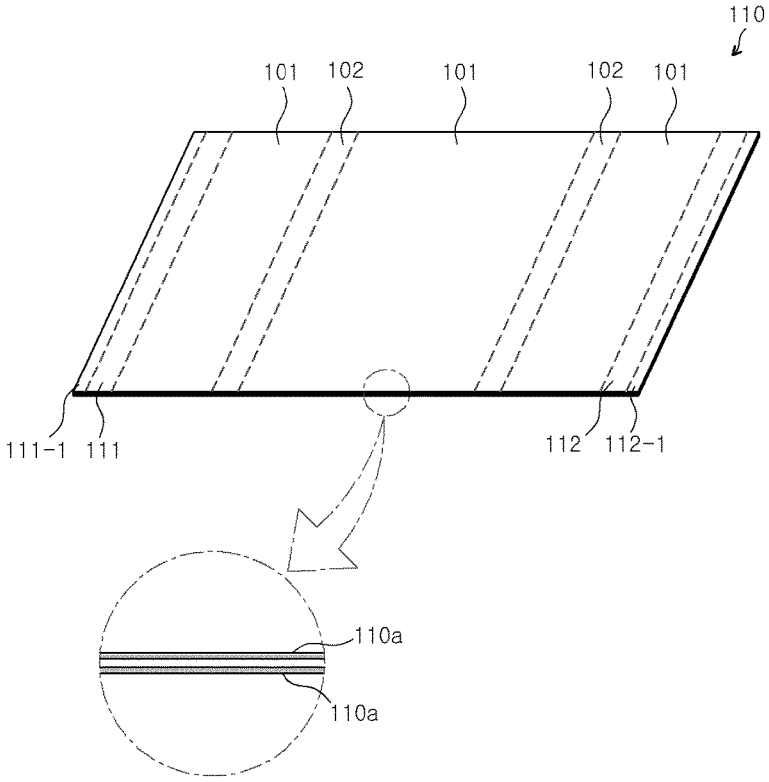
FIG. 13 is a development showing a first plate of the tube for a heat exchanger according to the present invention.
Figure 14:
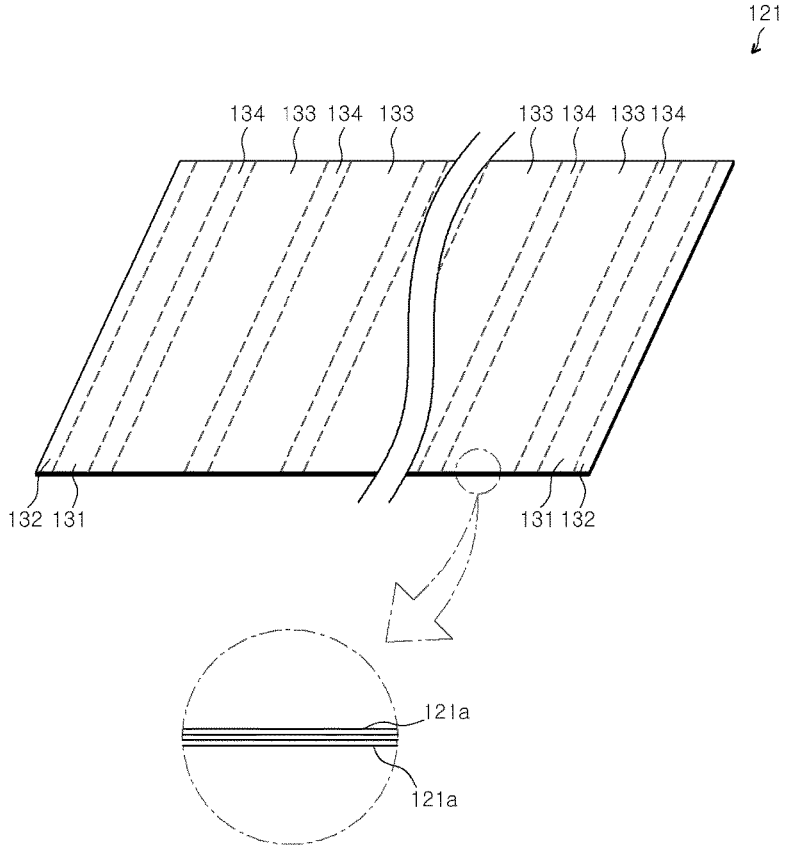
FIG. 14 is a development showing a second plate (which forms an inner fin) of the tube for a heat exchanger according to the present invention.

On the other hand, FIG. 13 is a development showing the first plate of the tube for a heat exchanger according to the present invention, and FIG. 14 is a development showing the second plate (which forms the inner fin) of the tube for a heat exchanger according to the present invention. As shown in FIGS. 13 and 14, the portions of the tube 100 and the inner fin 120 formed through bending are indicated by the corresponding reference numerals.

At this time, the clad materials 110*a* are applied to both side surfaces of the first plate 110 as shown in FIG. 13, and the clad materials 121*a* are applied to both side surfaces of the second plate 121 as shown in FIG. 14.

According to the present invention, if the clad material 110*a* is applied to the external surface of the first plate 110

Figure 15:
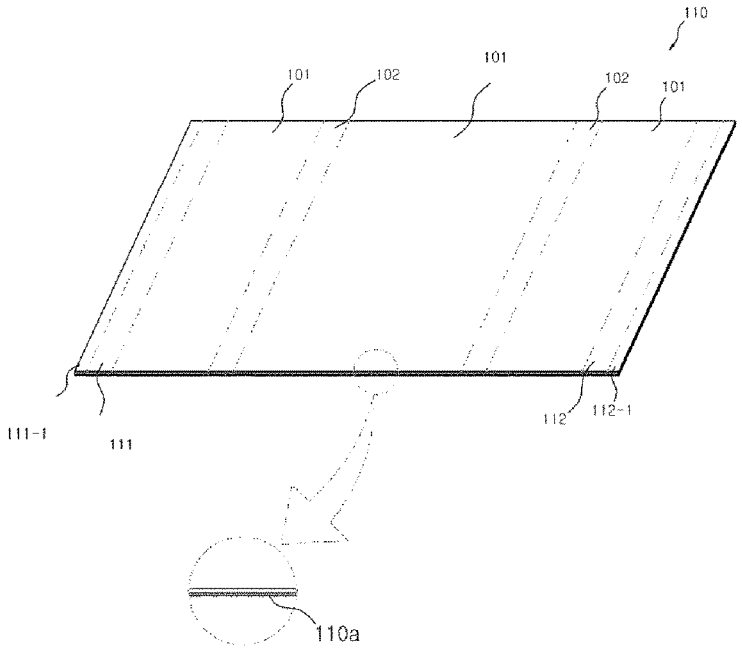
FIG. 15 is a perspective view of a first plate of the tube for a heat exchanger according to the present invention, wherein a clad material is applied to an external surface of the first plate.
Figure 16:
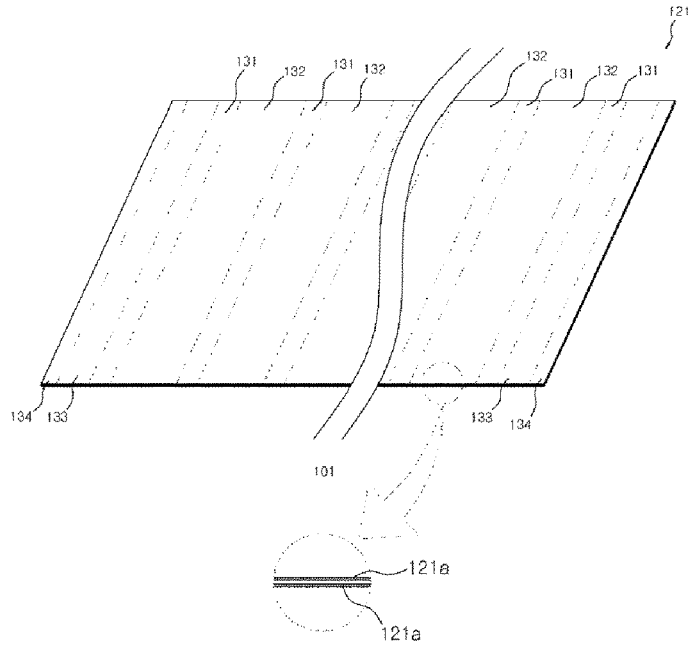
FIG. 16 is a perspective view of a second plate (which forms an inner fin) of the tube for a heat exchanger according to the present invention, wherein a clad material is applied to both side surfaces of the second plate.

(FIG. 15), the clad materials 121*a* are applied to both side surfaces of the second plate 121 (FIG. 16).

Figure 17:
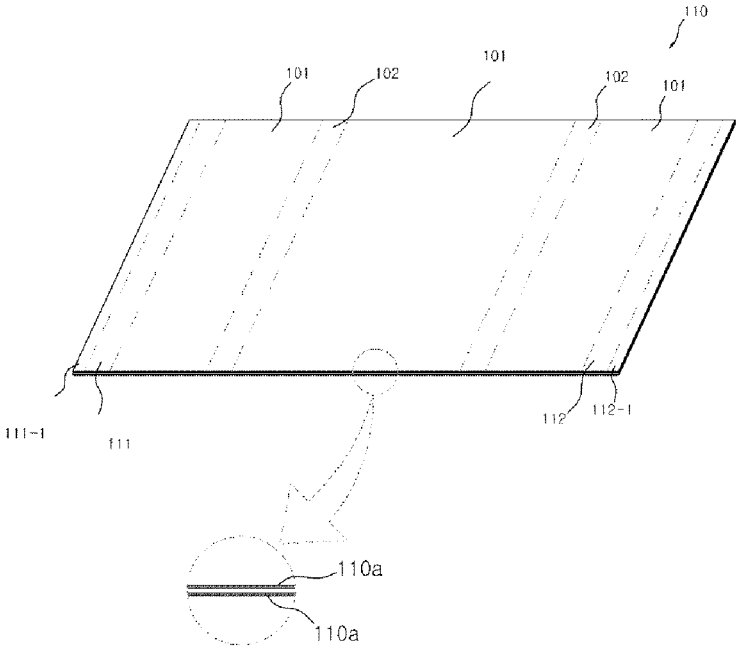
FIG. 17 is a perspective view of a first plate of the tube for a heat exchanger according to the present invention, wherein a clad material is applied to both side surfaces of the first plate.
Figure 18:
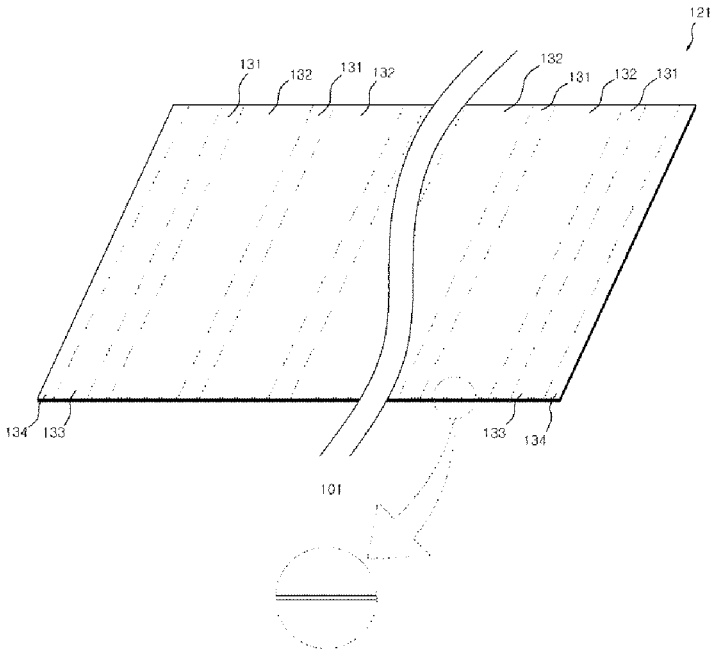
FIG. 18 is a perspective view of a second plate (which forms an inner fin) of the tube for a heat exchanger according to the present invention, wherein both side surfaces of the second plate are devoid of a clad material.
Figure 19:
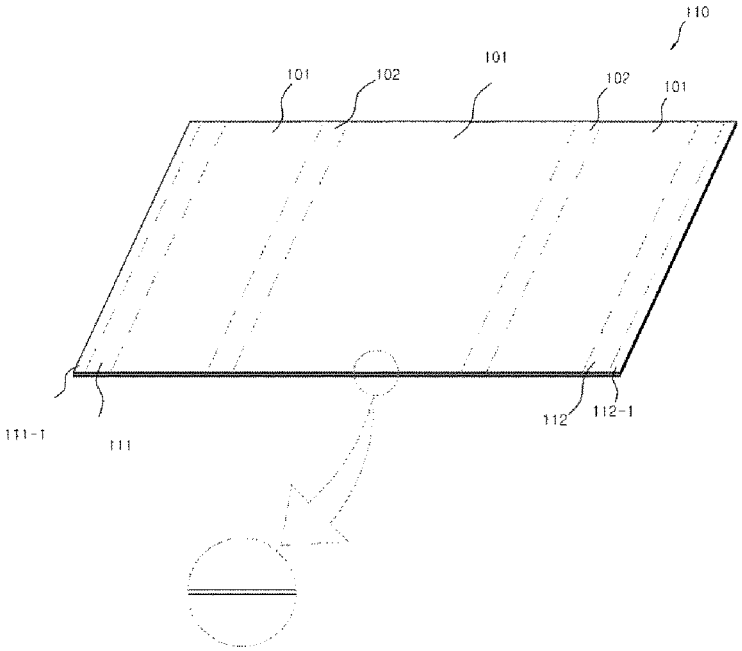
FIG. 19 is a perspective view of a first plate of the tube for a heat exchanger according to the present invention, wherein both side surfaces of the first plate are devoid of a clad material.
Figure 20:
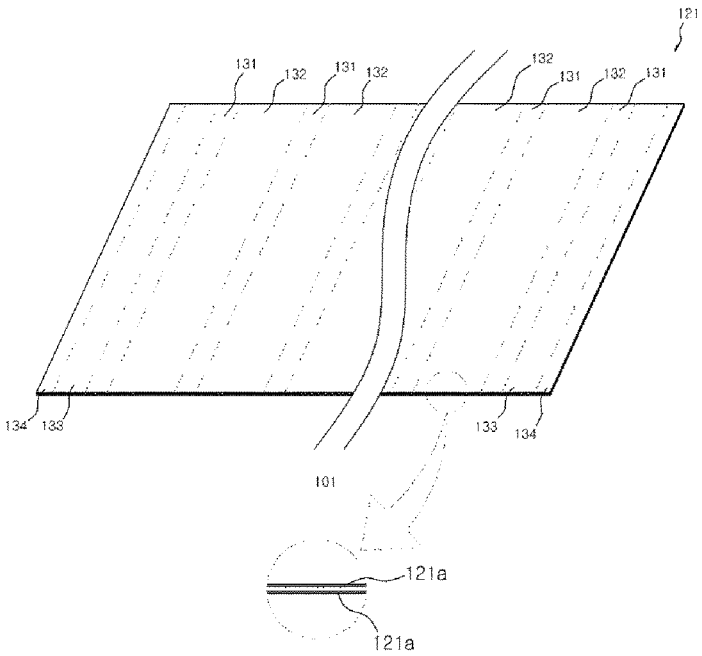
FIG. 20 is a perspective view of a second plate (which forms an inner fin) of the tube for a heat exchanger according to the present invention, wherein a clad material is applied to both side surfaces of the second plate.

Further, if the clad materials 110*a* are applied to both side surfaces of the first plate 110 (FIG. 17), no clad material 121*a* is applied to the second plate 121 (FIG. 18), and if no clad materials 110*a* are applied to both side surfaces of the first plate 110 (FIG. 19), the clad materials 121*a* are applied to both side surfaces of the second plate 121 (FIG. 20).

According to the present invention, particularly, the first plate 110 has a thickness D110 in the range of 0.1 to 0.2 mm, and the second plate 121 has a thickness D121 in the range of 0.05 to 0.12 mm, so that the tube 100 and the inner fin 120 are made of such thin plates, thus reducing the weight of the tube 100, achieving high productivity, increasing strength, and providing good durability.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A tube for a heat exchanger, which is connected between a pair of header tanks of the heat exchanger to form a heat exchanging medium passage and has an inner fin disposed at an inside thereof, the tube comprising:

plane portions disposed in parallel to each other in an air flow direction;

curved portions integrally formed on both sides of the plane portions to connect the plane portions with each other; and first reinforcement portions and second reinforcement portions formed on both end portions of the inner fin, the first reinforcement portions bonded to inner surfaces of the curved portions and the second reinforcement portions extended from the first reinforcement portions and bonded to inner surfaces of the first reinforcement portions, wherein one of the first reinforcement portions, one of the second reinforcement portions, and one of the curved portions share a common center of curvature, wherein the first reinforcement portions and the second reinforcement portions are continuously formed from both of the end portions of the inner fin without being broken and have a same curvature as each of the curved portions of the tube, and wherein the first reinforcement portions, the second reinforcement portions, and the inner fin have the same thickness and are formed thinner than the curved portions and the plane portions.

2. The tube for the heat exchanger according to claim 1, wherein the tube is formed by bending a first plate, and the first plate has a first partition wall-forming portion and a second partition wall-forming portion formed on given areas of both end portions thereof and a partition wall formed by bonding the first partition wall-forming portion and the second partition wall-forming portion to each other to divide an internal space of the tube into a first space portion and a second space portion in the air flow direction of the tube.

3. The tube for the heat exchanger according to claim 2, wherein the first plate comprises: a first extension portion extended from the end portion of the first partition wall-forming portion and bonded to an opposite surface of the first partition wall-forming portion to a surface of the first partition wall-forming portion contacted with the second partition wall-forming portion; and a second extension portion extended from the end portion of the second partition wall-forming portion and bonded to an opposite surface of the second partition wall-forming portion to a surface of the second partition wall-forming portion contacted with the first partition wall-forming portion.

4. The tube for the heat exchanger according to claim 3, wherein the first partition wall-forming portion and the second partition wall-forming portion have a bonding area formed to bond given areas of the first partition wall-forming portion and the second partition wall-forming portion to each other on an outside of the tube and a space-forming area formed at a first angle on remaining areas of the first partition wall-forming portion and the second partition wall-forming portion to form a third space portion among the first partition wall-forming portion, the second partition wall-forming portion and the inner fin.

5. The tube for the heat exchanger according to claim 4, wherein the first angle is in a range of 10 to 30°.

6. The tube for the heat exchanger according to claim 4, wherein the first partition wall-forming portion and the second partition wall-forming portion have a second angle formed when coming into contact with an external surface of the tube, and the second angle is in a range of 5 to 15°.

7. The tube for the heat exchanger according to claim 6, wherein the inner fin has a third angle formed between a reference line vertical to the air flow direction with respect to a center of a curvature radius of the curved portions of the tube and a line connecting an end of the second reinforcement portion and the center of the curvature radius of the curved portions of the tube, and the third angle is in a range of 10 to 45°.

8. The tube for the heat exchanger according to claim 2, wherein the inner fin is formed by bending a second plate, and the second plate has bonding portions and partitioning portions alternately formed thereon, the bonding portions being bonded to the plane portions of the tube to partition the internal space of the tube into a plurality of space portions and the partitioning portions being bent from the bending portions to partition the internal space of the tube in the air flow direction.

9. The tube for the heat exchanger according to claim 8, wherein the inner fin further comprises third reinforcement portions extended from the second reinforcement portions and bonded to the bonding portions.

10. The tube for the heat exchanger according to claim 8, wherein a clad material is applied to an external surface of the first plate, and the clad material is applied to both side surfaces of the second plate, respectively.

11. The tube for the heat exchanger according to claim 8, wherein a clad material is applied to both surfaces of the first plate and the clad material is not applied to both surfaces of the second plate.

12. The tube for the heat exchanger according claim 8, wherein the first plate has a thickness in a range of 0.1 to 0.2 mm.

13. The tube for the heat exchanger according to claim 8, wherein the second plate has a thickness in a range of 0.05 to 0.12 mm.

14. A tube for a heat exchanger, the tube connected between a pair of header tanks of the heat exchanger to form a heat exchanging medium passage, the tube having an inner fin disposed at an inside thereof, the tube comprising:

plane portions disposed in parallel to each other in an air flow direction;

curved portions integrally formed on both sides of the plane portions to connect the plane portions with each other; and first reinforcement portions and second reinforcement portions formed on both end portions of the inner fin, the second reinforcement portions extending from the first reinforcement portions, one of the first reinforcement portions and the second reinforcement portions bonded to inner surfaces of the curved portions, and an other of the first reinforcement portions and the second reinforcement portions bonded to the one of the first reinforcement portions and the second reinforcement portions, wherein one of the first reinforcement portions, one of the second reinforcement portions, and one of the curved portions share a common center of curvature, and wherein the first reinforcement portions and the second reinforcement portions are continuously formed from both of the end portions of the inner fin without being broken and have a same curvature as each of the curved portions of the tube, and wherein the first reinforcement portions, the second reinforcement portions, and the inner fin have the same thickness and are formed thinner than the curved portions and the plane portions.

* * * * *